US011767974B2

(12) United States Patent
Park et al.

(10) Patent No.: US 11,767,974 B2
(45) Date of Patent: Sep. 26, 2023

(54) GAS FURNACE

(71) Applicant: LG ELECTRONICS INC., Seoul (KR)

(72) Inventors: Janghee Park, Seoul (KR); Doyong Ha, Seoul (KR); Yongki Jeong, Seoul (KR); Jusu Kim, Seoul (KR); Hansaem Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 289 days.

(21) Appl. No.: 17/091,188

(22) Filed: Nov. 6, 2020

(65) Prior Publication Data

US 2021/0140630 A1 May 13, 2021

(30) Foreign Application Priority Data

Nov. 7, 2019 (KR) ..... 10-2019-0141387

(51) Int. Cl.
*F23D 14/02* (2006.01)
*F23D 14/62* (2006.01)

(52) U.S. Cl.
CPC ..... *F23D 14/02* (2013.01); *F23D 14/62* (2013.01); *F23D 2203/007* (2013.01); *F23D 2203/105* (2013.01)

(58) Field of Classification Search
CPC .... F23D 14/02; F23D 14/62; F23D 2203/007; F23D 2203/105
USPC ..... 126/110 C
See application file for complete search history.

(56) References Cited

U.S. PATENT DOCUMENTS 4,945,890 A * 8/1990 Ripka ..... F24H 9/1836 126/116 A
5,057,007 A * 10/1991 Andringa ..... F23D 14/105 431/328
5,997,285 A * 12/1999 Carbone ..... F23D 14/02 431/354
8,616,194 B2 * 12/2013 Sherrow ..... F24H 3/087 126/110 A
2012/0247444 A1 10/2012 Sherrow et al.
(Continued)

*Primary Examiner* — Avinash A Savani
(74) *Attorney, Agent, or Firm* — KED & ASSOCIATES

(57) ABSTRACT

A gas furnace according to an embodiment of the present disclosure includes: a mixer for mixing air and a fuel gas, which are introduced through an intake pipe and a manifold, respectively, to form a mixture; a mixing pipe through which the mixture, having passed through the mixer, flows; a burner assembly for producing a combustion gas by burning the mixture having passed through the mixing pipe; and heat exchangers through which the combustion gas flows, wherein the burner assembly includes: a plurality of burners, to which a flame produced during combustion of the mixture is anchored; a mixing chamber serving as a medium for delivering the mixture from the mixing pipe to the burners. Accordingly, a full premixing mechanism may be provided, and a mixing rate of the fuel gas and the air may be maximized, thereby greatly reducing nitrogen oxide emissions. Further, the burner assembly includes a uniform guide disposed inside the mixing chamber and allowing the mixture to be uniformly distributed to each of the plurality of burners, thereby preventing an increase in local flame temperature, and greatly reducing nitrogen oxide emissions.

16 Claims, 8 Drawing Sheets

(56) References Cited

U.S. PATENT DOCUMENTS

2013/0302737 A1* 11/2013 Schultz ..... F23D 14/58
165/135

* cited by examiner

GAS FURNACE

CROSS-REFERENCE TO RELATED APPLICATION

This application claims the priority from Korean Patent Application No. 10-2019-0141387, filed on Nov. 7, 2019, in the Korean Intellectual Property Office, the disclosure of which is incorporated herein by reference in its entirety.

BACKGROUND OF THE INVENTION

1. Field of the Invention

The present disclosure relates to a gas furnace, and more particularly to a gas furnace in which nitrogen oxide (NOx) emissions may be greatly reduced by premixing air and a fuel gas before combustion, maximizing a mixing rate of the air and the fuel gas, and uniformly distributing a mixture of the air and the fuel gas to a plurality of burners.

2. Description of the Related Art

Generally, a gas furnace is a heating device which heats the indoor air by supplying air heat-exchanged with a flame and high-temperature combustion gas which are produced during combustion of a fuel gas. FIG. 1 illustrates a general gas furnace.

Referring to FIG. 1, a flame and high-temperature combustion gas may be produced during combustion of a fuel gas and air in the burner assembly 4. Here, the fuel gas is fed from a gas valve (not shown) into the burner assembly 4 through a manifold 3. The high-temperature combustion gas may pass through a heat exchanger 5 to be discharged to the outside through an exhaust pipe 8. In this case, the indoor air, introduced by a blower 6 through an internal air duct D1, may be heated while passing through the heat exchanger 5, and then may be guided to an indoor space through the supply air duct D2, thereby heating the indoor space.

An inducer 7 induces the flow of the combustion gas passing through the heat exchanger 5 and the exhaust pipe 8, and condensate, which is generated as the combustion gas is condensed while passing through the heat exchanger 5 and/or the exhaust pipe 8, may be discharged to the outside through a condensate trap 9.

Thermal NOx (hereinafter briefly referred to as NOx) is formed as a result of chemical reaction between atmospheric nitrogen and oxygen at high temperature (more specifically, at a flame temperature of about 1800 K or higher) during combustion of the fuel gas in the gas furnace. As a typical air pollutant, the NOx emissions are regulated by the air quality management office.

For example, in the United States, NOx emissions are regulated by the South Coast Air Quality Management District (South Coast AQMD), which has recently tightened the regulations on a NOx emission limit from 40 ng/J (nano-grams per Joule) to less than 14 ng/J.

Accordingly, there has been active research on techniques for reducing NOx emissions in the gas furnace. U.S. 20120247444A1 discloses a premix gas furnace for premixing air and a fuel gas before combustion, in which flame temperature may be controlled by increasing the air ratio, thereby reducing NOx emissions.

However, the premix gas furnace has problems in that the fuel gas is directly injected into the intake pipe, such that the fuel gas and the air are mixed insufficiently, thereby causing the formation of nitrogen oxide emissions due to the locally increased flame temperature.

Further, the general gas furnace, including the premix gas furnace disclosed in U.S. 20120247444A1, fails to disclose a structure for preventing the formation of nitrogen oxide emissions, caused by the locally increased flame temperature, by supplying the mixture uniformly to each of a plurality of burners.

SUMMARY OF THE INVENTION

It is a first object of the present disclosure to provide a gas furnace which provides a full premixing mechanism to reduce nitrogen oxide emissions.

It is a second object of the present disclosure to provide a gas furnace, in which by maximizing a mixing rate of the fuel gas and air, the increase in local flame temperature may be prevented, thereby greatly reducing the nitrogen oxide emissions.

It is a third object of the present disclosure to provide a gas furnace, in which by distributing a mixture of the fuel gas and air uniformly to each of the plurality of burners, the increase in local flame temperature may be prevented, thereby greatly reducing the nitrogen oxide emissions.

The objects of the present disclosure are not limited to the aforementioned objects and other objects not described herein will be clearly understood by those skilled in the art from the following description.

In accordance with an aspect of the present disclosure, the above and other objects can be accomplished by providing a gas furnace, including: a mixer for mixing air and a fuel gas, which are introduced through an intake pipe and a manifold, respectively, to form a mixture; a mixing pipe through which the mixture, having passed through the mixer, flows; a burner assembly for producing a combustion gas by burning the mixture having passed through the mixing pipe; and heat exchangers through which the combustion gas flows, wherein the burner assembly may include: a plurality of burners, to which flames produced during combustion of the mixture are anchored; and a mixing chamber serving as a medium for delivery of the mixture from the mixing pipe to the burners. Accordingly, a full premixing mechanism may be provided, and a mixing rate of the fuel gas and the air may be maximized, thereby greatly reducing nitrogen oxide emissions. Further, the burner assembly may include a uniform guide disposed inside the mixing chamber and allowing the mixture to be uniformly distributed to each of the plurality of burners, thereby preventing an increase in local flame temperature, and greatly reducing nitrogen oxide emissions.

The uniform guide may be formed as a distribution plate which is disposed in the inner space of the mixing chamber, extends in the horizontal direction, and has a predetermined open area.

The distribution plate may be connected to an inner surface in the horizontal direction of the mixing chamber, and may be spaced apart by a predetermined distance from an inner surface in a vertical direction of the mixing chamber.

The uniform guide may be formed as a distribution mesh disposed in the inner space of the mixing chamber and having a plurality of pores.

The distribution mesh may be formed with a ceramic honeycomb material; and each of the plurality of pores may have a size in a range of 0.7 mm2 to 1.3 mm2.

The uniform guide may be formed as a distribution filter disposed in the inner space of the mixing chamber and serving to filter out foreign matter flowing along with the mixture. The distribution filter may be connected to the inner surface of the mixing chamber.

Other unmentioned technical solutions can be clearly understood from the following description by those having ordinary skill in the technical field to which the present disclosure pertains.

DETAILED DESCRIPTION OF THE PREFERRED EMBODIMENTS

Figure 1:
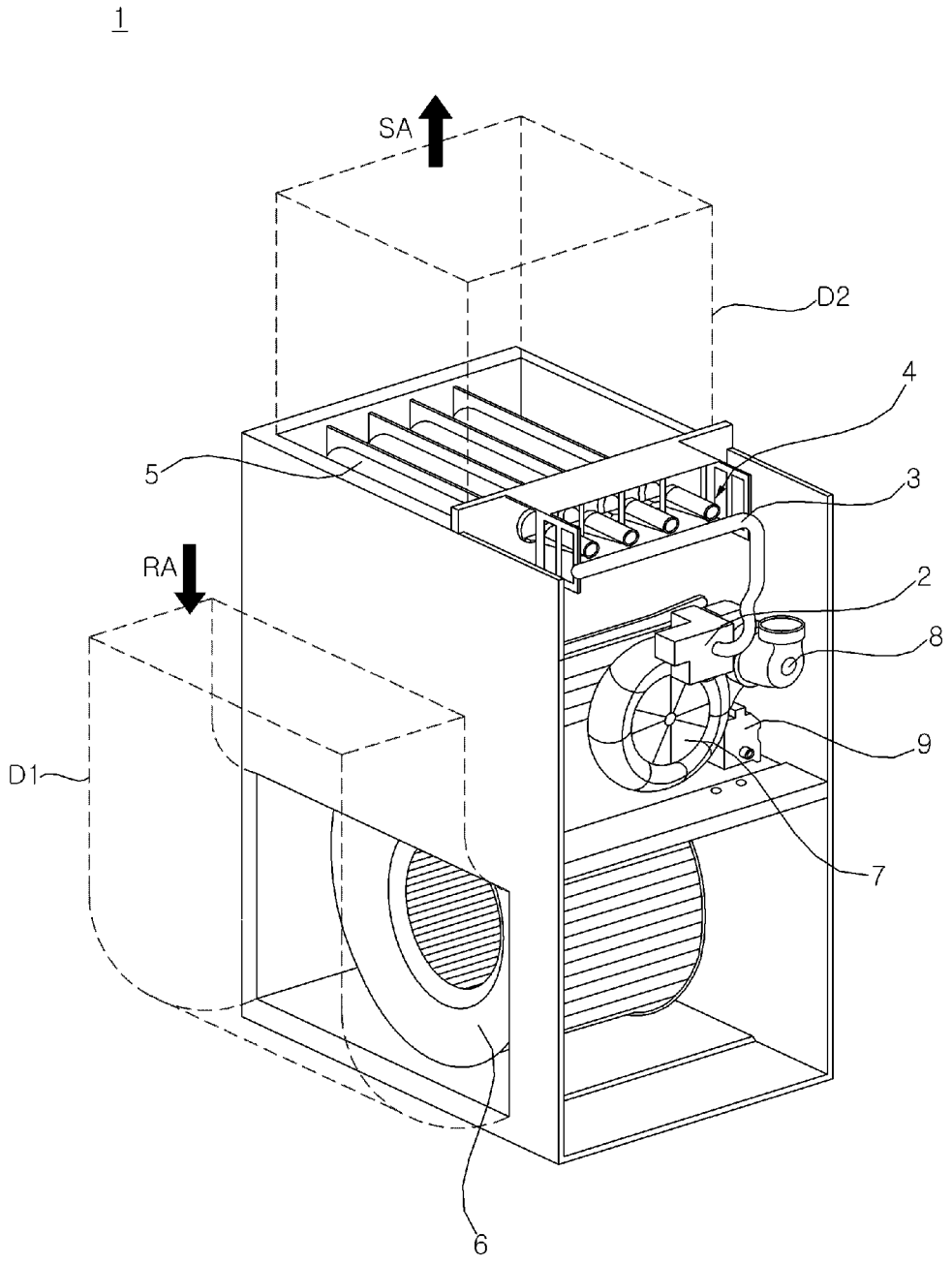
FIG. 1 is a perspective view of a general gas furnace.

Advantages and features of the present disclosure and methods for accomplishing the same will be more clearly understood from exemplary embodiments described below with reference to the accompanying drawings. However, the present disclosure is not limited to the following embodiments but may be implemented in various different forms. The embodiments are provided only to complete disclosure of the present disclosure and to fully provide a person having ordinary skill in the art to which the present disclosure pertains with the category of the present disclosure, and the present disclosure will be defined by the scope of the appended claims. Wherever possible, like reference numerals generally denote like elements through the specification.

Figure 2:
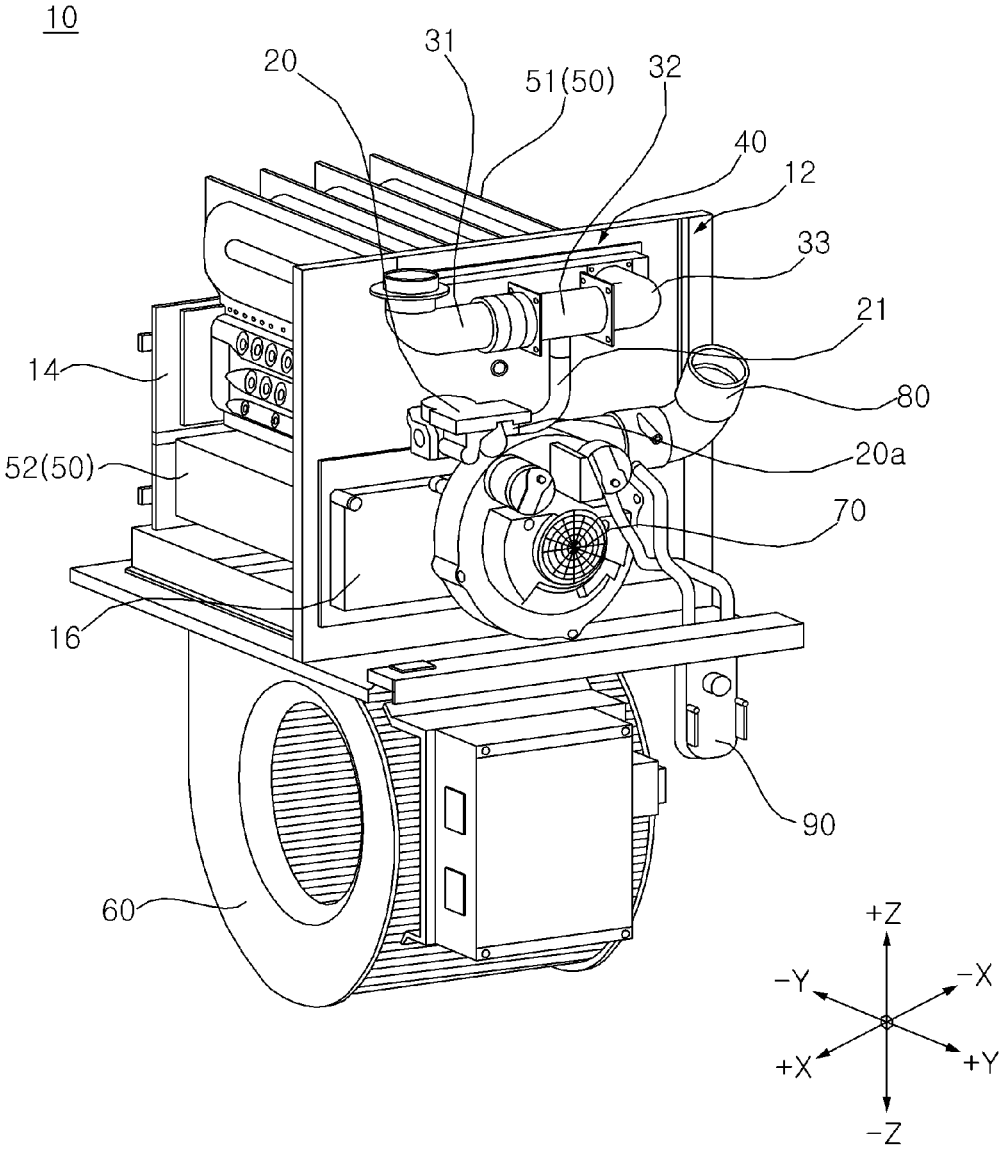
FIG. 2 is a perspective view of a gas furnace according to an embodiment of the present disclosure.

The present disclosure may also be described based on a spatial orthogonal coordinate system with X, Y and Z axes mutually crossing at right angles, as illustrated in FIG. 2 and the like. In the present disclosure, the X, Y and Z axes are defined based on the direction of the Z axis being defined as a longitudinal (up-down) direction and the direction of the X axis being defined as a first lateral (front-rear) direction and the direction of the Y axis being defined as a second lateral (sideways) direction. Directions of each axis (directions of the X, Y, and Z axes) may indicate both directions in which each of the axes extends; and +X-, +Y-, and +Z-axis directions having a plus sign ("+") may indicate a positive direction, which is either one of both directions in which each of the axes extends. Further, −X-, −Y-, and −Z-axis directions having a minus sign ("−") may indicate a negative direction, which is the other one of both directions in which each of the axes extends.

Hereinafter, a gas furnace according to embodiments of the present disclosure will be described in further detail with reference to FIGS. 2 to 8.

FIG. 2 is a perspective view of a gas furnace according to an embodiment of the present disclosure.

The gas furnace 10 according to an embodiment is a device for heating an indoor space by heat exchanging air with flames and a high-temperature combustion gas C, which are produced during combustion of a fuel gas F, and supplying the heat-exchanged air to the indoor space.

Referring to FIG. 2, the gas furnace 10 includes: a mixer 32 in which air A and the fuel gas F and/or an exhaust gas E are mixed; a mixing pipe 33 through which the mixture, having passed through the mixer 32, flows; a burner assembly 40 for producing the combustion gas C by burning the mixture having passed through the mixing pipe 33; and a heat exchanger 50 through which the combustion gas C flows.

In addition, the gas furnace 10 includes: an inducer 70 for inducing the flow of the combustion gas C to pass through the heat exchanger 50 to be discharged through an exhaust pipe 80; a blower 60 for blowing the air, to be supplied to the indoor space, around the heat exchanger 50; and a condensate trap 90 for collecting a condensate, generated in the heat exchanger 50 and/or the exhaust pipe 80, and discharging the collected condensate to the outside.

The air A may be introduced into the mixer 32 through an intake pipe 31, and the fuel gas F may flow from a gas valve 20 and a nozzle 21*a* into the mixer 32 through a manifold 21. Here, as the fuel gas F, Liquefied Natural Gas (LNG) may be used, which is natural gas that has been cooled down to liquid form, or Liquefied Petroleum Gas (LPG) may be used, which is a by-product of crude oil refining and is pressurized into liquid form.

By the opening and closing of the gas valve 20, the fuel gas F may be supplied to the manifold 21 or may be blocked from flowing to the manifold 21. By controlling a degree of opening of the gas valve 20, it is possible to control an amount of the fuel gas F supplied to the manifold 21. Accordingly, the gas valve 20 may control the heating power of the gas furnace 10.

The mixture of the air and the fuel gas F may flow through the mixing pipe 33, as will be described later. The mixing pipe 33 may guide the mixture to the burner assembly 40 which will be described later, and the mixture of the air and the fuel gas F may be continuously mixed even while being guided to the burner assembly 40 by the mixing pipe 33.

The mixture, fed into the burner assembly 40, may be burned by ignition provided by an igniter. In this case, the flames and high-temperature combustion gas C may be produced during combustion of the mixture.

The heat exchanger 50 may include a flow passage through which the combustion gas C may flow. The following description is given of an example in which the gas furnace 10 includes the heat exchanger 40 including a primary heat exchanger 51 and a secondary heat exchanger 52, but the heat exchanger 50 may include only the primary heat exchanger 51 depending on embodiments.

One end of the primary heat exchanger 51 may be disposed adjacent to the burner assembly 40. The other end thereof, which is opposite the one end of the primary heat exchanger 51, may be connected to a Hot Collect Box (HCB) 14. The combustion gas C, flowing from the one end to the other end of the primary heat exchanger 51, may be transferred to the secondary heat exchanger 52 through the HCB 14.

One end of the secondary heat exchanger 52 may be connected to the HCB 14. The combustion gas C, having passed through the primary heat exchanger 51, may flow through the one end of the secondary heat exchanger 52 to pass therethrough. The secondary heat exchanger 52 may heat exchange, once again, the combustion gas C, having passed through the primary heat exchanger 51, with air passing around the secondary heat exchanger 52. That is, as heat energy from the combustion gas, having passed through the primary heat exchanger 51, may be used again by the secondary heat exchanger 52, the efficiency of the gas furnace 10 may be improved.

Condensate is generated as the combustion gas C, passing through the secondary heat exchanger 52, is condensed by heat transfer with air passing around the secondary heat exchanger 52. In other words, water vapor contained in the combustion gas C may be condensed and transformed into condensate. For this reason, the gas furnace 10, including the primary heat exchanger 51 and the secondary heat exchanger 52, is called a condensing gas furnace. In this case, the generated condensate may be collected in a Cold Collect Box (CCB) 16. To this end, the one end of the secondary heat exchanger 52 and the other end thereof, which is opposite the one end, may be connected to a one side surface of the CCB 16.

The condensate generated by the secondary heat exchanger 52 may flow out of the condensate trap through the CCB 16 and then may be discharged outside of the gas furnace 10 through a discharge port. In this case, the condensate trap 90 may be connected to the other side surface of the CCB 16. Further, the condensate trap 90 may collect and discharge not only the condensate, generated in the secondary heat exchanger 52, but also condensate generated in the exhaust pipe 80 connected to the inducer 70. That is, condensate, which is generated when the combustion gas C, which has not yet been condensed at the other end of the secondary heat exchanger 52, is condensed by passing through the exhaust pipe 80, may also be collected in the condensate trap 90, and may be discharged outside of the gas furnace 10 through the discharge port.

The inducer 70, which will be described later, may be connected to the other side surface of the CCB 16. For convenience explanation, the following description is given of an example in which the inducer 70 is connected to the CCB 16, but the inducer 70 may also be connected to a mounting plate 12 having the CCB 16 connected thereto.

The CCB 16 may have an opening. The other end of the secondary heat exchanger 52 and the inducer 70 may communicate with each other through the opening formed at the CCB 16. That is, the combustion gas C, having passed through the other end of the secondary heat exchanger 52, may flow out of the inducer 70 through the opening formed at the CCB 16, and may be discharged outside of the gas furnace 10 through the exhaust pipe 80.

The inducer 70 may communicate with the other end of the secondary heat exchanger 52 through the opening formed at the CCB 16. One end of the inducer 70 is connected to the other side surface of the CCB 16, and the other end of the inducer 70 may be connected to the exhaust pipe 80. The inducer 70 may induce the flow of the combustion gas C to pass through the primary heat exchanger 51, the HCB 14, and the secondary heat exchanger 52, to be discharged through the exhaust pipe 80. In this regard, the inducer 70 may be called an Induced Draft Motor (IDM).

The blower 60 may be disposed at a lower part of the gas furnace 10. The blower 60 may cause the air, to be supplied to the indoor space, to move upward from the lower part of the gas furnace 10. In this regard, the blower 60 may be called an Indoor Blower Motor (IBM).

The blower 60 may cause the air to pass around the heat exchanger 50. Temperature of the air, passing around the heat exchanger 50 by the blower 60, may be increased as the air receives heat energy transferred from the combustion gas C via the heat exchanger 50. As the air with increased temperature is supplied to the indoor space, the indoor space may be heated.

As in the general gas furnace 1 illustrated in FIG. 1, the gas furnace 10 may include a case (not numbered). The above components of the gas furnace 10 may be accommodated in the case.

The case may have a lower opening (not numbered), which is formed at a lower side of the case on a side surface adjacent to the blower 60. An internal air duct D1, through which the air introduced from the indoor space (hereinafter referred to as indoor air RA) passes, may be installed at the lower opening. A supply air duct D2, through which the air to be supplied to the indoor space (hereinafter referred to as supply air SA) passes, may be installed at an upper opening (not numbered) which is formed at an upper side of the case.

That is, once the blower 60 operates, temperature of the air increases while the air, introduced from the indoor space as the indoor air RA through the internal air duct D1, passes through the heat exchanger 50, such that the air with increased temperature may be supplied to the indoor space as the supply air SA through the supply air duct D2, thereby heating the indoor space.

When compared to the gas furnace 10 according to the above embodiment and the following embodiments of the present disclosure which will be described later, the general gas furnace 1 illustrated in FIG. 1 is different from the gas furnace 10 of the present disclosure, and the differences are as follows.

That is, in the general gas furnace 1, a fuel gas, having passed through a manifold 3, is injected into a burner assembly 4 through a nozzle installed at the manifold 3, and the fuel gas may pass through a Venturi tube (not numbered) of the burner assembly 4 to be mixed with air naturally aspirated into the burner assembly 4, to form a mixture. However, the general gas furnace 1 may have difficulty in reducing nitrogen oxide (NOx) emissions for the following reasons.

First, it can be understood that the general gas furnace 1 provides a partial pre-mixing mechanism having diffusion combustion characteristics, in which the fuel gas, injected through the nozzle, passes through the Venturi tube along with primary air, introduced through a space between a lower side of the burner assembly 4 and the nozzle, to be mixed as a mixture, and then the mixture is burned with secondary air introduced through a space between an upper side of the burner assembly 4 and the heat exchanger 5.

However, due to the diffusion combustion characteristics that a flame spread speed is considerably slower than the speed of combustion chemical reaction, the gas furnace having such partial pre-mixing mechanism may have difficulty in reducing the flame temperature even by oversupplying the secondary air. Furthermore, the gas furnace may also have difficulty in controlling an air ratio (i.e., ratio of actual air supply to the theoretical amount of air), such that there is a limitation in reducing nitrogen oxide (NOx) emissions.

In order to solve the above problems, the present disclosure has been devised to provide the gas furnace 10 including a full premixing mechanism, in which by increasing a mixing rate of the fuel gas and air, the increase in local flame temperature may be prevented, thereby reducing the nitrogen oxide (NOx) emissions. The gas furnace 10 will be described in further detail below.

Figure 3:
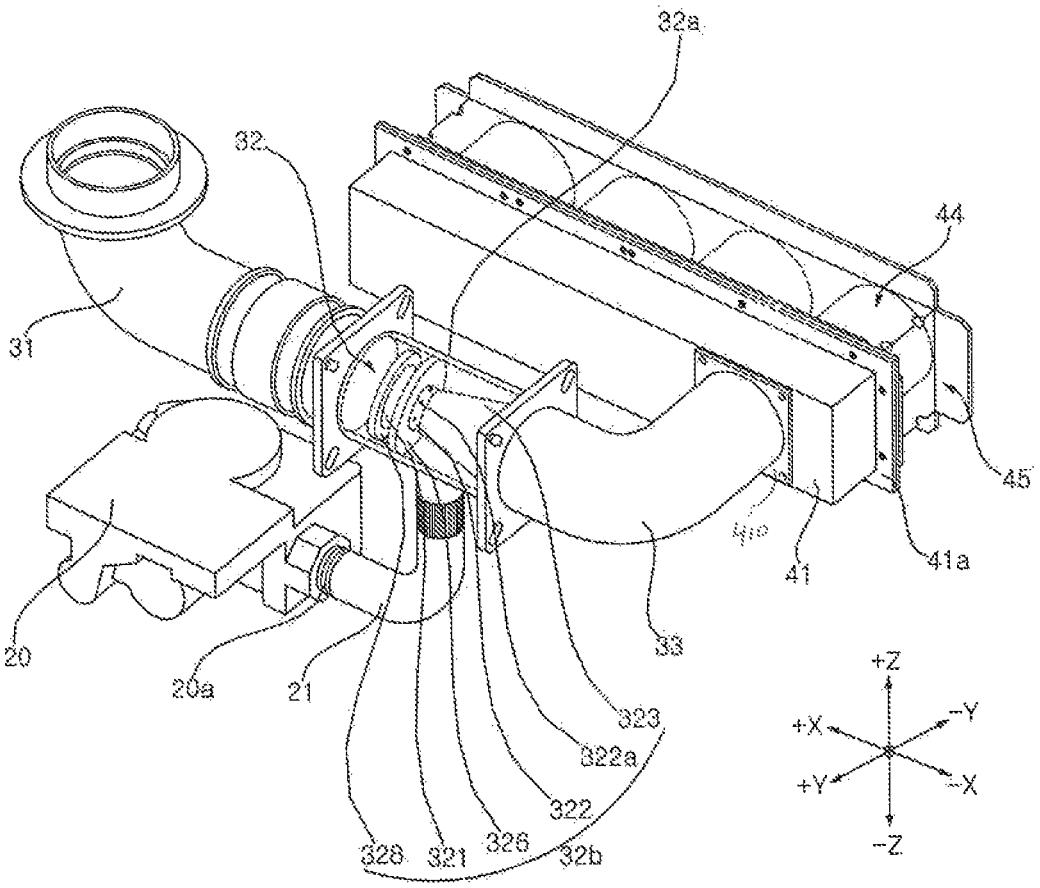
FIG. 3 is a partial perspective view of a gas furnace according to an embodiment of the present disclosure.

FIG. 3 is a partial perspective view of a gas furnace according to an embodiment of the present disclosure.

Referring to FIGS. 2 and 3, the gas furnace 10 includes a mixer 32, a mixing pipe 33, a burner assembly 40, a heat exchanger 50, an exhaust pipe 80, an inducer 70, and a blower 60.

The inducer 70 induces the air A to flow into the mixer 32 through the intake pipe 31, induces a mixture, which will be described below, to flow from the mixing pipe 33 to the burner assembly 40, and induces a combustion gas C, which will be described below, to flow from the burner assembly 40 to the heat exchanger 50 and the exhaust pipe 80. Further, the blower 60 may cause the flow of air passing around the heat exchanger 50.

The mixer 32 forms a mixture by mixing the air A, introduced from each of the intake pipe 31 and the manifold 21, and a fuel gas F. Here, the intake pipe 31 is a pipe having one side exposed to the outside, such that air participating in combustion may be drawn through the intake pipe 31; and the manifold 21 is a pipe having one side connected to the gas valve 20, such that the fuel gas F participating in combustion may flow through the manifold 21. The amount of the fuel gas F, flowing through the manifold 21, may be controlled by opening and closing the gas valve 20 or by controlling the degree of opening of the gas valve 20, as described above. In addition, the gas furnace 10 may further include a controller for controlling the opening and closing of the gas valve 20 or the degree of opening of the gas valve 20.

The mixture, formed by the mixer 32, may pass through the mixing pipe 33 to be fed into the burner assembly 40, and the air A participating in combustion may be fully pre-mixed with the fuel gas F to be fed into the burner assembly 40, such that the flame temperature may be reduced easily by controlling the air ratio (i.e., controlling the amount of drawn air so that air may be oversupplied for combustion). Further, the intake pipe 31, the mixer 32, the mixing pipe 33, the burner assembly 40, and the heat exchanger 50 communicate with each other, such that the flame temperature may be reduced easily by controlling the air ratio by the operation of the inducer 70, thereby greatly reducing nitrogen oxide (NOx) emissions. In other words, conditions of combustion in a lean area for reducing the NOx emissions may be readily achieved.

The present disclosure may provide the Venturi effect to increase a mixing rate of the air A and the fuel gas F in the mixer 32, which will be described in further detail below.

The mixer 32 includes a mixer housing 32*a* and a Venturi tube 32*b*. An intake pipe 31 may be connected to a front end of the mixer housing 32*a*, a mixing pipe 33 may be connected to a rear end of the mixer housing 32*a*, and a manifold 21 may be connected to a side surface of the mixer housing 32*a*. Here, the intake pipe 31 may be connected to the mixer housing 32*a* via an intake pipe connector 31*a*, and the mixing pipe 33 may be integrally connected to the rear end of the mixer housing 32*a*, but the arrangement is not limited thereto.

That is, the air A and the fuel gas F may flow into the mixer 32 through the intake pipe 31 and the manifold 21, respectively, to be mixed and then fed into the mixing pipe 33.

The Venturi tube 32*b* may be provided inside the mixer housing 32*a*. An outer circumferential surface of each of a converging section 321, a throat 322, and a diverging section 323 of the Venturi tube 32*b*, which will be described below, may be disposed on an inner circumferential surface of the mixer housing 32*a* at positions spaced apart from each other at predetermined intervals.

In addition, the Venturi tube 32*b* may include a flange 326 which extends outwards from the outer circumferential surface of the Venturi tube 32*b*, to be pressed against the inner circumferential surface of the mixer housing 32*a*, such that the Venturi tube 32*b* may be fixed to the inside of the mixer housing 32*a*.

The Venturi tube 32*b* may include the converging section 321, the throat 322, and the diverging section 323.

The converging section 321 has on one end an air inlet, through which the air A, having passed through the intake pipe 31, is introduced; and a flange 328 may be formed on an outer circumferential surface of the one end. A pressure sensor may be installed at the flange 328, to sense the pressure of air flowing through the Venturi tube 32*b*.

The converging section 321 may have a diameter which decreases toward a downstream side. Accordingly, the pressure of air passing through the converging section 321 may drop (further, flow rate increases) and a negative pressure may be formed, which is known as the Venturi effect. In this case, the air pressure drop may allow the fuel gas F to easily flow through a fuel inlet hole 322*a* of the throat 322. Further, as the flow rate of the air increases, a turbulence intensity in the air flow increases, thereby increasing a mixing rate of the air A and the fuel gas F, which will be described below.

The throat 322 may be connected to the converging section 32, and may have the fuel inlet hole 322*a*, through which the fuel gas F having passed through the manifold 21 is introduced, and which is formed on at least a portion of the side surface of the throat 322.

The fuel inlet hole 322*a* may include a plurality of fuel inlet holes 322*a* which are spaced apart from each other at predetermined intervals in a circumferential direction of the throat 322, thereby allowing the fuel gas F to be smoothly flow through the Venturi tube 32*b*.

The fuel inlet holes 322*a* may be formed at positions corresponding to a space between the flange 326 as the side surface of the throat 322 and a connection portion of the manifold 21 in the mixer housing 32*a*. In this manner, compared to the case where the fuel inlet holes 322*a* are formed at a connection portion of the manifold 21 in the mixer housing 32, it is possible to prevent the fuel gas F from being supplied intensively through some of the fuel inlet holes 322*a*, thereby allowing the fuel gas F to be supplied uniformly through all the fuel inlet holes 321*a*.

The diverging section 323 may be connected to the throat 322, and the air A and the fuel F, having passed through the converging section 321 and the fuel inlet holes 322*a*, respectively, may be mixed and may flow through the diverging section 323 as a mixture.

The diverging section 323 may have a diameter which increases toward the downstream side. Accordingly, the pressure, which drops while passing through the converging section 321, may be recovered to a predetermined value while passing through the diverging section 323, and the air A and the fuel gas F may be mixed more easily. Further, the diverging section 323 may have at one end a discharge port, through which the mixture is discharged to the mixing pipe 33.

In addition, the Venturi tube 32*b* may include the flange 326 which extends outwards from an outer circumferential surface of a portion connected to the throat 322 in the converging section 321, to be pressed against the inner circumferential surface of the mixer housing 32*a*. The flange 326 not only fixes the Venturi tube 32*b* to the inside of the mixer housing 32*a* but also prevents the fuel gas F, having passed through the manifold 21, from flowing outside of the converging section 321.

Figure 4:
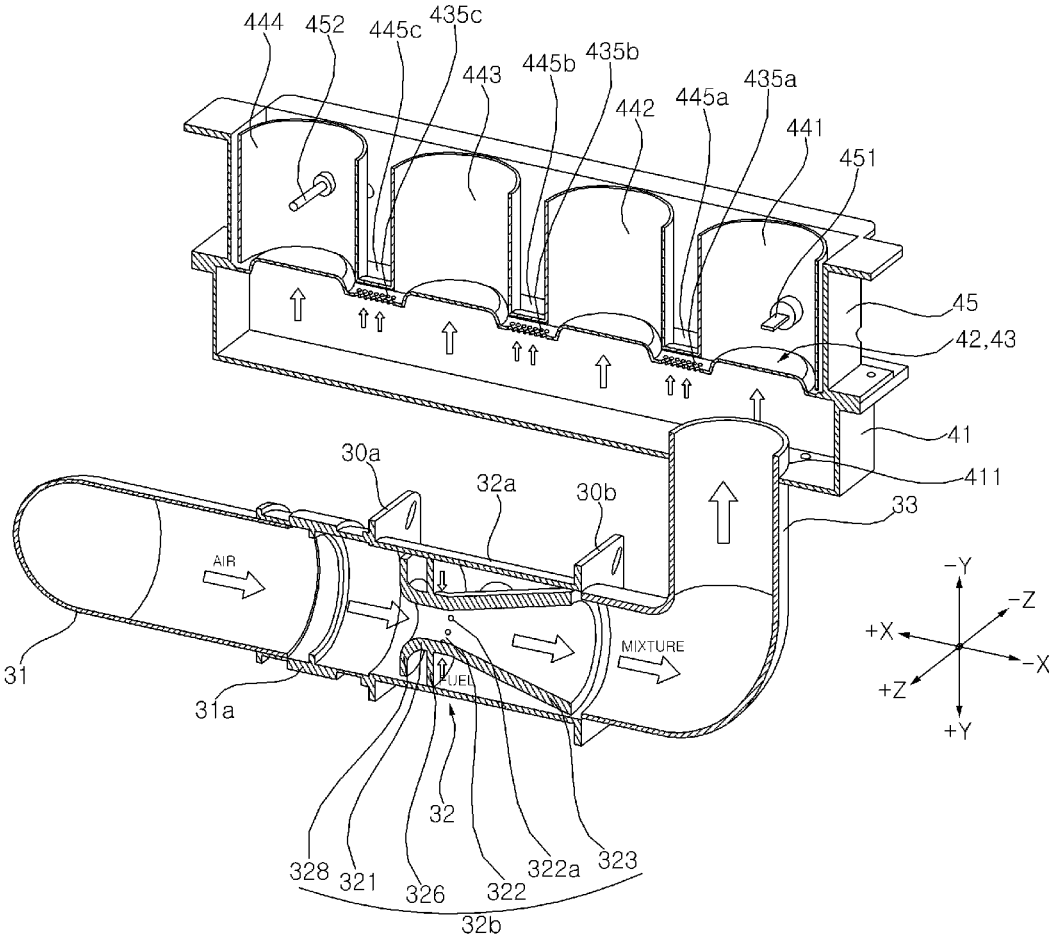
FIG. 4 is a partial sectional view of a gas furnace according to an embodiment of the present disclosure.

FIG. 4 is a partial sectional view of a gas furnace according to an embodiment of the present disclosure.

Referring to FIG. 4, the mixture, having passed through the mixer 32, may flow through the mixing pipe 33. The mixing pipe 33 may guide the mixture to the burner assembly 40. The burner assembly 40 may produce a flame and high-temperature combustion gas C by burning the mixture having passed through the mixing pipe 33.

The burner assembly 40 may include a mixing chamber 41, a burner 42, a burner plate 43, combustion chambers 44: 441, 442, 443, and 444, and a burner box 45. The gas furnace 10 may include a plurality of primary heat exchangers 51. In this case, the gas furnace 10 may include a plurality of burners 42 and a plurality of combustion chambers 44, in which the burners 42 and the combustion chambers 44 are provided in number equal to the number of the primary heat exchangers 51. For example, the gas furnace 10 may include four primary heat exchangers 51 disposed parallel to each other, and four burners 42 and four combustion chambers 44 corresponding to the four primary heat exchangers 51.

The mixing chamber 41 may serve as a medium for delivery of the mixture from the mixing pipe 33 to the burner 42. That is, the mixing pipe 33 may be connected to a connector 410 provided at one side of the mixing chamber 41, such that the mixture, having passed through the mixing pipe 33, may flow into the mixing chamber 41 through the connector 410 and then may be fed into the burner 42. The mixture of the air and the fuel gas may be continuously mixed even while being guided to the burner 42 through the mixing chamber 41.

The flame, produced by the combustion of the mixture, may be anchored to the burner 42. For example, the burner 42 may include a perforated burner plate 42*a* and a burner mat 42*b*.

The perforated burner plate 42*a* may have a plurality of ports, through which the mixture is ejected. For example, the perforated burner plate 42*a* may be made of a stainless material. The perforated burner plate 42*a* may serve to uniformly distribute the mixture to the burner mat 42*b* which will be described below. In this case, the flow of the mixture is redistributed between the perforated burner plate 42*a* and the burner mat 42*b*, thereby effectively providing a uniform flow of the mixture. In addition, compared to a case where the burner 42 includes only the burner mat 42*b*, the burner 42 includes the perforated burner plate 42*a* as well as the burner mat 42*b* as described above, such that flame stability may be improved. Further, the perforated burner plate 42*a* may also serve to support the burner mat 42*b*.

The burner mat 42*b* may be connected to an upper part of the perforated burner plate 42*a*, and may distribute the mixture, ejected through the ports of the perforated burner plate 42*a*, more uniformly, thereby allowing the flame to be stably anchored to the burner mat 42*b*. For example, the burner mat 42*b* may be made of a metal fiber having pores smaller than the diameter of the ports. The burner mat 42*b* may be understood as a circular array of cylinders in which the ejection speed of the mixture is close to zero, such that the flames may be stably anchored to the surface of the burner mat 42*b*. As a result, flame stability may be greatly improved, and the heating power of the gas furnace may be efficiently adjusted in a wide range. That is, the burner mat 42*b* may be effective in preventing flame flash-back in the case where the heating power of the gas furnace is considerably reduced, and in preventing flame blow-out in the case where the heating power of the gas furnace is considerably increased.

A plurality of burners 42 may be connected to one side of the burner plate 43. A plurality of burner holes, communicating with the plurality of combustion chambers 44, may be formed on a body of the burner plate 43.

One end of the combustion chamber 44 may be connected to the other side of the burner plate 43, and the other end of the combustion chamber 44 may be disposed adjacent to a plurality of primary heat exchangers 51. The mixing chamber 41 may be connected to one end of the burner box 45, and one side of the mounting plate 12 may be connected to the other end of the burner box 45. Further, the burner 42, the burner plate 43, and the combustion chamber 44 may be provided inside the burner box 45.

In addition, the gas furnace 10 may further include an igniter 451 disposed inside the combustion chamber 44. For example, the igniter 451 may be installed on an inner surface of the burner box 45, to be inserted into a hole of the combustion chamber 44. Once the mixture, fed into the burners 42 through the connector 410, is burned by the ignition provided by the igniter 451, flames and high-temperature combustion gas C may be produced, and the produced flames may be anchored to the burners 42.

Even when the igniter 451 is disposed in only any one of the plurality of combustion chambers 44 (i.e., first combustion chamber 441), the flames may be spread to adjacent burners through flame spread holes 435: 435*a*, 435*b*, and 435*c* formed in the burner plate 43. In this case, the burner assembly 40 may include flame spread tunnels 445: 445*a*, 445*b*, and 445*c* which are formed between adjacent combustion chambers 44 at positions corresponding to the flame spread holes 435, thereby forming a flame spread path with the flame spread holes 435.

The flame spread tunnels 445 may prevent the mixture, ejected from the flame spread holes 435, from leaking to the outside, thereby allowing the flame spread holes 435 to serve a function in spreading the flames between the adjacent individual burners.

The mixture, having passed through the mixing pipe 33, may pass through the mixing chamber 41 to be distributed not only to the plurality of burners 42 but also to the flame spread holes 435, and the flames may be spread between the adjacent burners 42 along the flame spread path formed between the flame spread holes 435 and the flame spread tunnels 445.

That is, flames may be spread between individual burners via the flame spread holes 453 according to the mechanism in which the flame, anchored to any one of the burners 42 adjacent to the flame spread holes 435, burns the mixture ejected from the flame spread holes 435 to produce a flame, and the produced flame burns the mixture ejected from another one of the burners 42 adjacent to the flame spread holes 435 to produce a flame.

The high-temperature combustion gas C, having passed through the combustion chambers 44, may be fed into the heat exchangers 51. That is, the high-temperature combustion gas C, produced by each of the burners 42, may pass through each of the plurality of combustion chambers 44 to be guided to each of the plurality of heat exchangers 51, such that heat loss may be reduced compared to the case of integrated burners facing a plurality of heat exchangers (i.e., a case where some of the flames and high-temperature combustion gases C, produced by the integrated burners, escape through the plurality of heat exchangers, thereby causing heat loss).

In addition, the gas furnace 10 may further include a flame detector 452 disposed inside the combustion chamber 44. For example, the flame detector 452 may be installed on an inner surface of the burner box 45, to be inserted into a hole formed at the combustion chamber 44. Based on the characteristics that flames may be spread sequentially through the flame spread holes of the present disclosure, it is possible to detect whether flames are formed in response to operation of the gas furnace even when the flame detector 452 is disposed in only any one of the plurality of combustion chambers 44. When the flame detector 452 detects that flames are not formed in response to operation of the gas furnace, which may cause a safety risk, such that it is required to block the supply of fuel gas F to the manifold 21 by closing the gas valve 20.

The heat exchanger 50 may include a gas passage, through which the high-temperature combustion gas C, produced by the combustion, flows. The combustion gas (hereinafter referred to as an exhaust gas E), having passed through the heat exchanger 50, may pass through the inducer 70 to be discharged to the outside through the exhaust pipe 80. In this case, the condensate generated in the heat exchanger 50, particularly the secondary heat exchanger 52 and the exhaust pipe 80, may be collected in the condensate trap 90 to be discharged to the outside.

Figure 5:
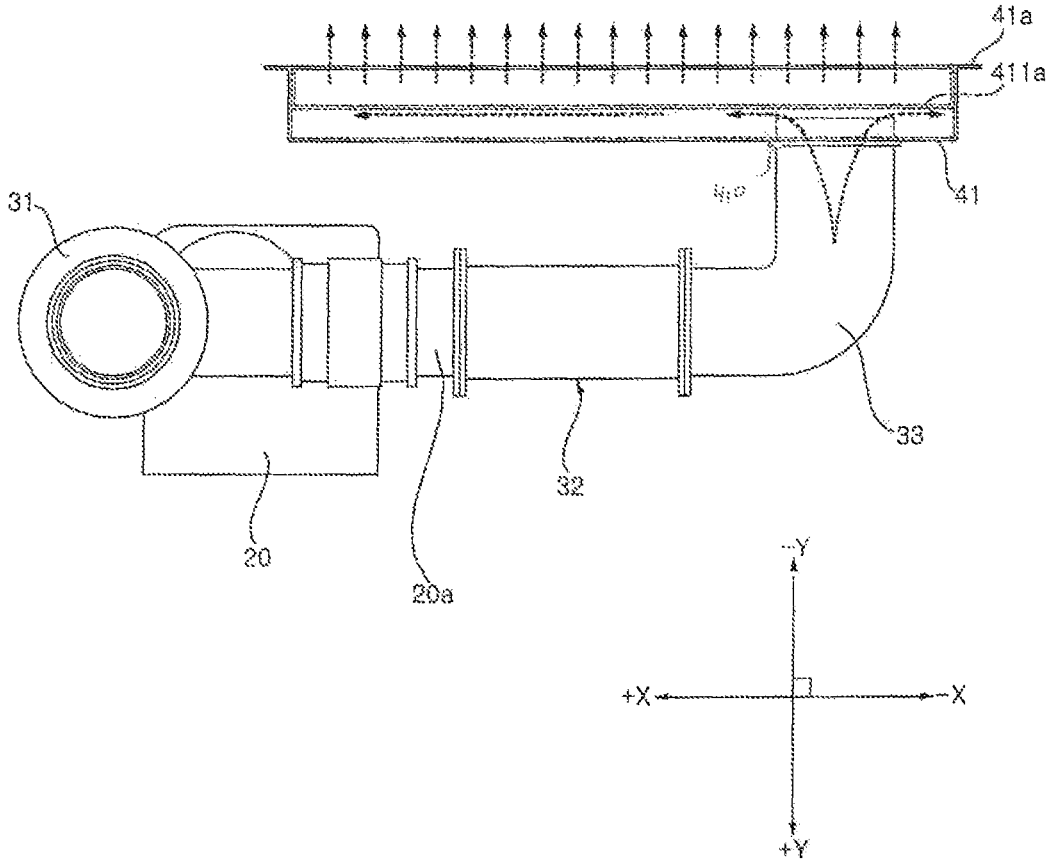
FIG. 5 is a diagram explaining a uniform guide serving to distribute a mixture uniformly to each of a plurality of burners in a gas furnace according to an embodiment of the present disclosure.

FIG. 5 is a diagram explaining a uniform guide serving to distribute a mixture uniformly to each of a plurality of burners in a gas furnace according to an embodiment of the present disclosure.

Referring to FIG. 5, the uniform guide 411 may be disposed inside the mixing chamber 41 to allow the mixture to be distributed uniformly to each of the plurality of burners 42. Particularly, even when the connector 410 is formed at an end portion on any one side in a first lateral direction of the mixing chamber 41, the uniform guide 411 may allow the mixture to be distributed uniformly to each of the plurality of burners 42.

The uniform guide 411 may be disposed between the mixing pipe 33 and the plurality of burners 42 at a position spaced apart by a predetermined distance from each of the mixing pipe 33 and the plurality of burners 42.

That is, the uniform guide 411 is disposed in a flow path of the mixture, which extends from the mixing pipe 33 to the plurality of burners 42, and forms a predetermined pressure load to provide a uniform flow field of the mixture to each of the burners 42.

The uniform guide 411 may be detachably installed in the mixing chamber 41. In this manner, when the uniform guide 411 is required to be replaced or repaired, the uniform guide 411 may be easily detached from the mixing chamber 41.

Figure 6:
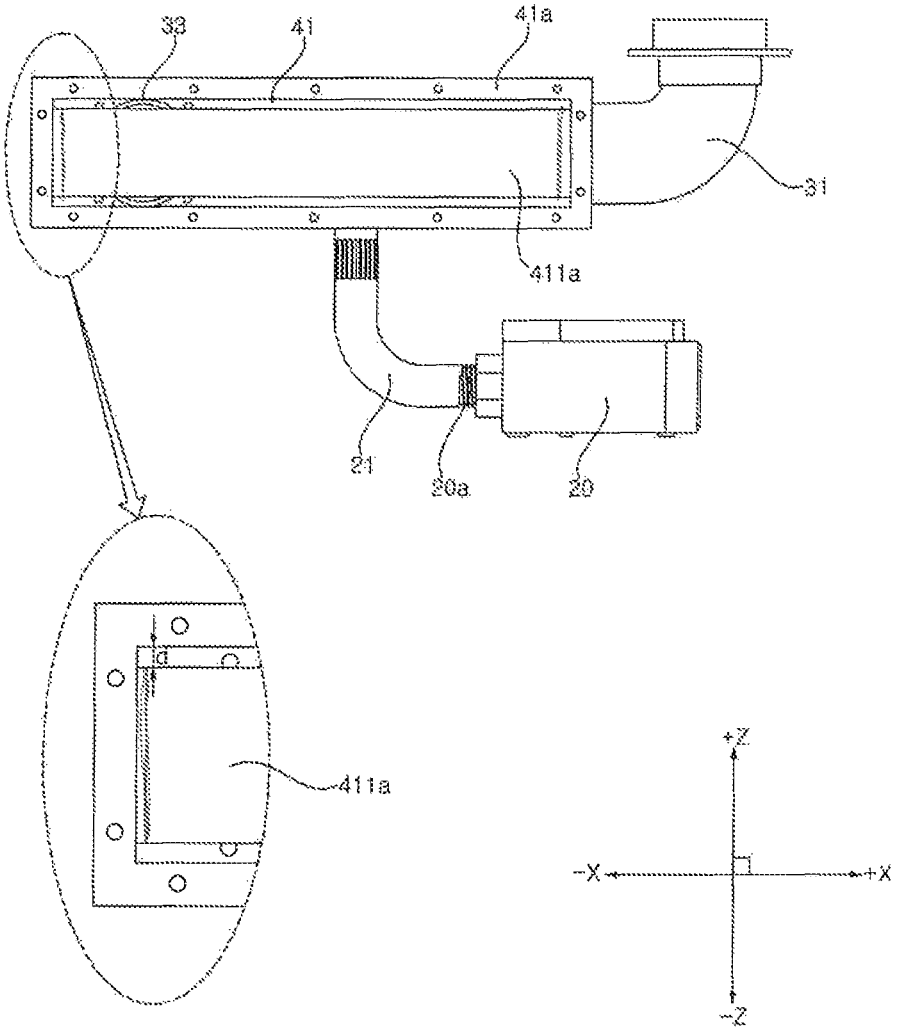
FIG. 6 is a diagram illustrating a distribution plate installed as a uniform guide in a mixing chamber according to a first embodiment of the present disclosure.

FIG. 5 and FIG. 6 is a diagram illustrating a distribution plate installed as a uniform guide in a mixing chamber according to a first embodiment of the present disclosure.

Referring to FIG. 6, the uniform guide 411 according to the first embodiment may include a distribution plate 411*a*. The distribution plate 411*a* may extend in a first lateral direction (i.e., X-axis direction). For example, the distribution plate 411*a* may be formed as a rectangular plate. In this case, the distribution plate 411*a* may be connected to an inner surface in the first lateral direction of the mixing chamber 41. Further, the distribution plate 411*a* may have a predetermined open area.

For example, in order not to hinder the distribution plate 411*a* from forming a uniform flow field of the mixture, the distribution plate 411*a* may be bent in a direction opposite to a direction in which both end portions in the first lateral direction of the mixing chamber 41 are directed toward the connector 410, so as to be connected to the inner surface in the first lateral direction of the mixing chamber 41. However, the means and construction of the distribution plate 411*a* connected to the inner surface in the first lateral direction of the mixing chamber 41 are not limited thereto.

In addition, the distribution plate 411*a* may be spaced apart by a predetermined distance d from the inner surface in a longitudinal direction (i.e., Z-axis direction) of the mixing chamber 41.

For example, the distribution plate 411*a* may be spaced apart from the inner surface in the longitudinal direction of the mixing chamber 41 by a distance d in a range of 2 mm to 13 mm. As a result, the mixture flowing into the mixing chamber 41 from the mixing pipe 33 may be distributed in a width direction (first lateral direction) of the distribution plate 411*a*, and may flow uniformly through upper and lower sides of the distribution plate 411*a*.

Figure 7:
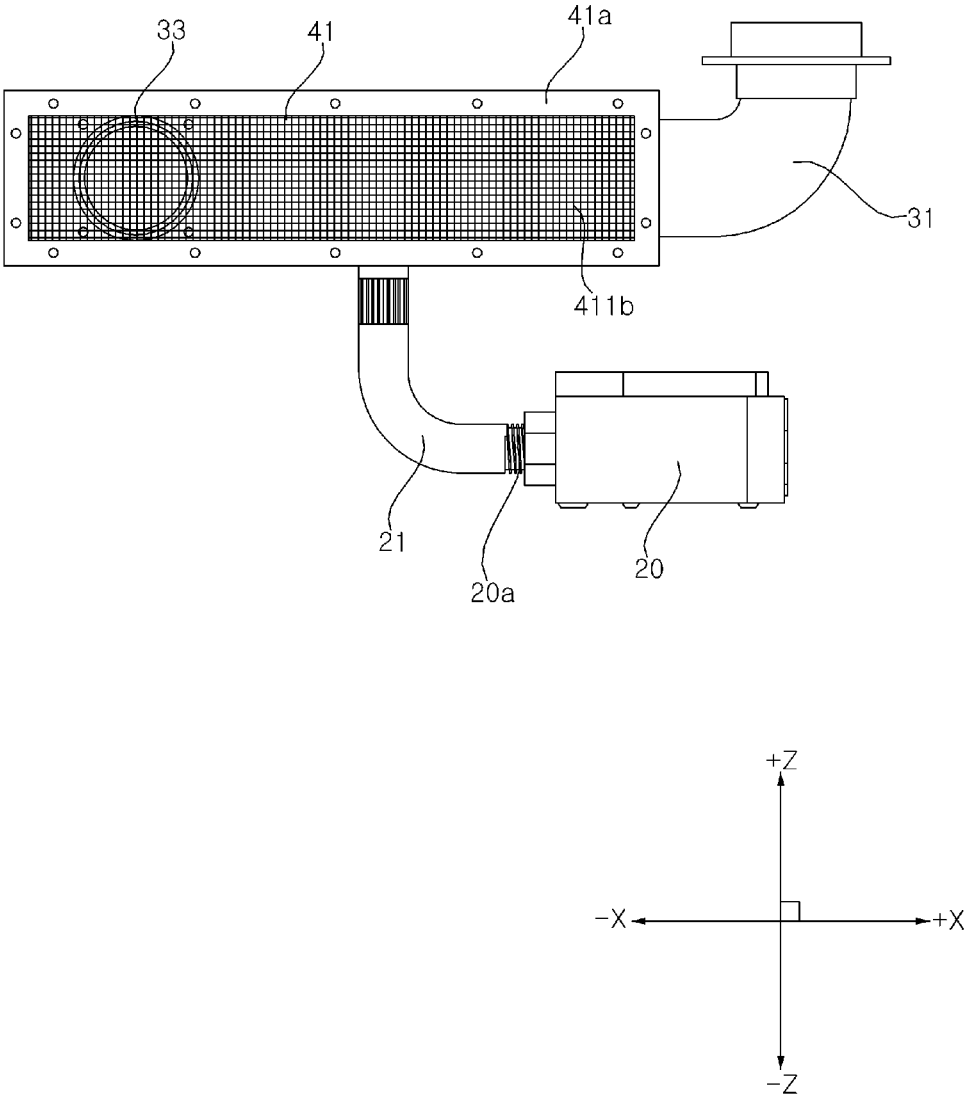
FIG. 7 is a diagram illustrating a distribution mesh installed as a uniform guide in a mixing chamber according to a second embodiment of the present disclosure.

FIG. 7 is a diagram illustrating a distribution mesh installed as a uniform guide in a mixing chamber according to a second embodiment of the present disclosure.

Referring to FIG. 7, the uniform guide 411 according to the second embodiment may include a distribution mesh 411*b*. The distribution mesh 411*b* may have a plurality of pores. In this case, the distribution mesh 411*b* may be connected to inner surfaces in the first lateral and longitudinal directions of the mixing chamber 41.

Further, the plurality of pores may have a uniform size. For example, the distribution mesh 411*b* may be formed with a ceramic honeycomb material, and each of the plurality of pores may have a size in a range of 0.7 mm2 to 1.3 mm2.

As a result, the mixture flowing into the mixing chamber 41 from the mixing pipe 33 may flow uniformly to each of the plurality of burners 42 under a pressure load formed by the mesh 411*b*.

Figure 8:
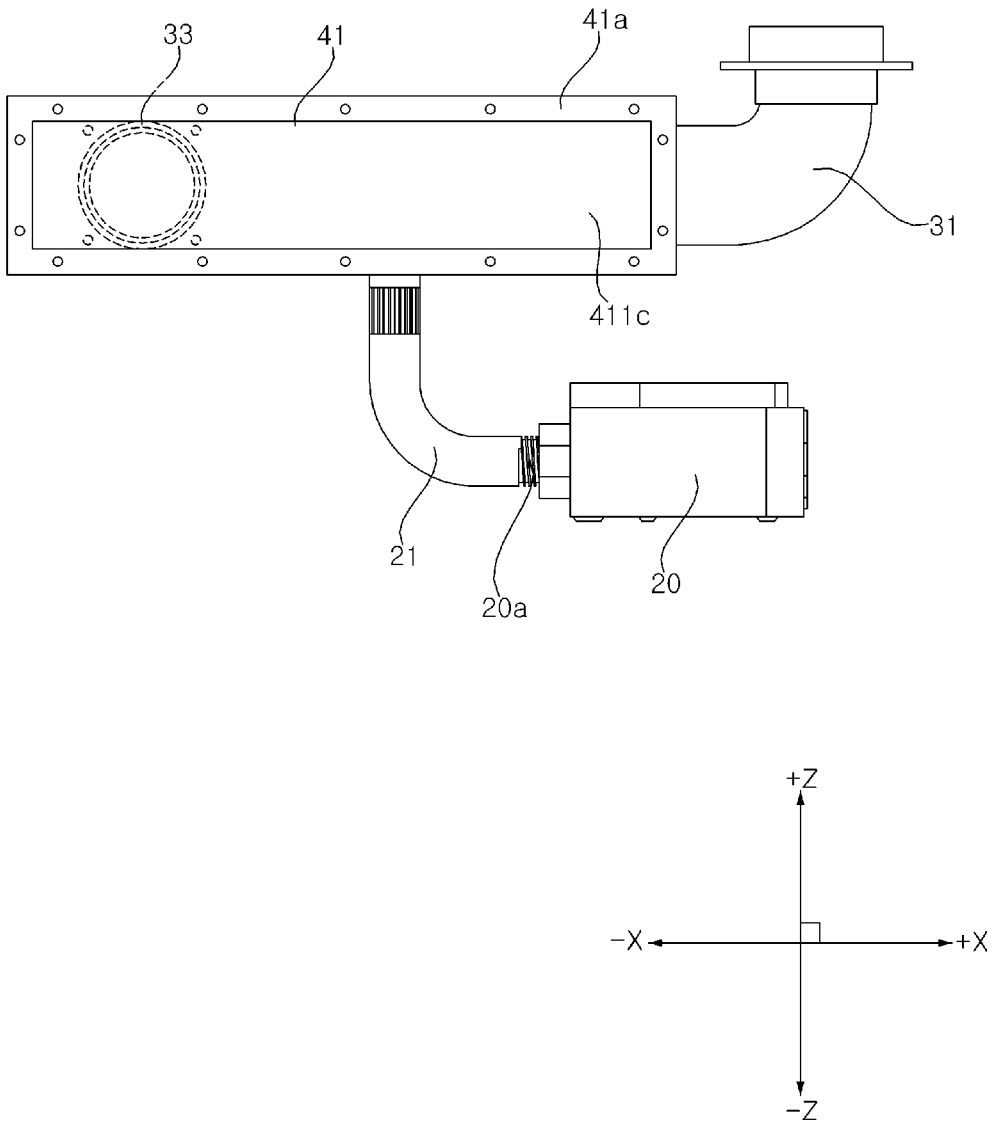
FIG. 8 is a diagram illustrating a distribution filter installed as a uniform guide in a mixing chamber according to a third embodiment of the present disclosure.

FIG. 8 is a diagram illustrating a distribution filter installed as a uniform guide in a mixing chamber according to a third embodiment of the present disclosure.

Referring to FIG. 8, the uniform guide 411 according to the third embodiment may include a distribution filter 411*c*. The distribution filter 411*c* may also serve to filter out foreign matter flowing along with the mixture. In this case, the distribution filter 411*c* may be connected to inner surfaces in the first lateral and longitudinal directions of the mixing chamber 41.

As a result, the mixture flowing into the mixing chamber 41 from the mixing pipe 33 may flow uniformly to each of the plurality of burners 42 under a pressure load formed by the distribution filter 411*c*.

The gas furnace according to the present disclosure has one or more of the following effects.

First, by fully premixing the air and fuel before combustion in the burner assembly, it is possible to easily control an amount of air intake for operation in the lean region, such that the nitrogen oxide emissions may be easily reduced.

Secondly, the air and fuel gas are mixed in the mixer while passing through the Venturi tube, such that a mixing rate thereof may be increased and nitrogen oxide emissions may be greatly reduced, compared to the case where flame temperature is locally increased due to a relatively low mixing rate.

Thirdly, the uniform guide, disposed inside the mixing chamber, may allow the mixture to be distributed uniformly to each of a plurality of burners, thereby preventing the formation of nitrogen oxide caused by the locally increased flame temperature.

Fourthly, the uniform guide is detachably installed in the mixing chamber, such that the uniform guide may be replaced and repaired easily.

Fifthly, at least a portion of the mixing pipe is inserted into the mixing chamber, thereby preventing leakage of the mixture during delivery of the mixture from the mixing pipe to the mixing chamber.

While the gas furnace according to the embodiments of the present disclosure has been described above with reference to the accompanying drawings, it should be understood that the present disclosure is not limited to the aforementioned embodiments, and various modifications and equivalent embodiments may be possible without departing from the scope and spirit of the disclosure as defined by the appended claims. Therefore, the scope of the present disclosure should be limited only by the accompanying claims and equivalents thereof.

What is claimed is:

1. A gas furnace, comprising:

a mixer that mixes air and a fuel gas, which are introduced through an intake pipe and a manifold, respectively, to form a mixture;

a mixing pipe through which the mixture, having passed through the mixer, flows;

a burner assembly that produces a combustion gas by burning the mixture having passed through the mixing pipe; and heat exchangers through which the combustion gas flows, wherein the burner assembly comprises:

a plurality of burners spaced apart from each other at predetermined intervals in a first lateral direction, to which flames produced during combustion of the mixture are anchored;

a mixing chamber that serves as a medium for delivery of the mixture from the mixing pipe to the plurality of burners; and a uniform guide disposed inside of the mixing chamber and that allows the mixture to be uniformly distributed to each of the plurality of burners, wherein the uniform guide is formed as a distribution plate which is disposed in an inner space of the mixing chamber, extends in the first lateral direction, is connected to an inner surface in the first lateral direction of the mixing chamber, and is spaced apart by a predetermined distance from the inner surface in a longitudinal direction of the mixing chamber, and wherein the plurality of burners is spaced apart from the uniform guide in a second lateral direction.

2. The gas furnace of claim 1, wherein the heat exchangers are provided in a number corresponding to a number of the plurality of burners, and are spaced apart from each other at predetermined intervals.

3. The gas furnace of claim 1, wherein the mixing chamber has, on a first side, a connector, to which the mixing pipe is connected, and a second side of the mixing chamber, which is opposite to the first side, is open such that the plurality of burners is disposed on the second side.

4. The gas furnace of claim 3, wherein the mixing chamber extends lengthwise in the first lateral direction.

5. The gas furnace of claim 1, wherein the distribution plate is spaced apart from the inner surface in the longitudinal direction of the mixing chamber by a distance in a range of 2 mm to 13 mm.

6. The gas furnace of claim 1, wherein ends of the distribution plate are bent in a direction away from the connector, so as to be connected to the inner surface in the first lateral direction of the mixing chamber.

7. The gas furnace of claim 4, wherein the distribution plate comprises a distribution mesh disposed in the inner space of the mixing chamber and having a plurality of pores.

8. The gas furnace of claim 7, wherein the plurality of pores have a uniform size.

9. The gas furnace of claim 8, wherein:

the distribution mesh is formed with a ceramic honeycomb material; and each of the plurality of pores has a size in a range of 0.7 $mm^2$ to 1.3 $mm^2$.

10. The gas furnace of claim 4, wherein the distribution plate comprises a distribution filter disposed in the inner space of the mixing chamber and serving to filter out foreign matter flowing along with the mixture.

11. The gas furnace of claim 4, wherein the uniform guide is detachably installed in the mixing chamber.

12. The gas furnace of claim 4, wherein at least a portion of the mixing pipe is inserted into the mixing chamber through the connector.

13. The gas furnace of claim 12, wherein the uniform guide is disposed between the mixing pipe and the plurality of burners at a position spaced apart by a predetermined distance from each of the mixing pipe and the plurality of burners.

14. The gas furnace of claim 4, wherein:

the connector is formed at an end portion on any one side in the first lateral direction of the mixing chamber; and the gas furnace further comprises an igniter disposed at an upper side of a burner, which is located adjacent to the connector, among the plurality of burners, and configured to ignite the mixture.

15. The gas furnace of claim 14, further comprising:

flame spread holes that mediate flame spread between the plurality of burners; and a flame detector disposed at an upper side of a burner, which is located farthest from the connector, among the plurality of burners, and configured to detect whether a flame is produced by combustion of the mixture.

16. The gas furnace of claim 1, wherein the mixer comprises:

a mixer housing having a front end connected to the intake pipe, a rear end connected to the mixing pipe, and a side surface connected to the manifold; and a Venturi tube connected to an inside of the mixer housing.

* * * * *